US012484751B2

(12) United States Patent
Campani et al.

(10) Patent No.: US 12,484,751 B2
(45) Date of Patent: Dec. 2, 2025

(54) VACUUM CLEANER

(71) Applicant: Dyson Technology Limited, Wiltshire (GB)

(72) Inventors: Massimo Camplani, Bristol (GB); Andrew Collingwood Watson, Gloucester (GB); David Alan Millington, Swindon (GB); Nathan Lawson McLean, Bristol (GB)

(73) Assignee: Dyson Technology Limited, Wiltshire (GB)

( * ) Notice: Subject to any disclaimer, the term of this patent is extended or adjusted under 35 U.S.C. 154(b) by 395 days.

(21) Appl. No.: 18/014,644

(22) PCT Filed: Jun. 3, 2021

(86) PCT No.: PCT/GB2021/051376
§ 371 (c)(1),
(2) Date: Jan. 5, 2023

(87) PCT Pub. No.: WO2022/008872
PCT Pub. Date: Jan. 13, 2022

(65) Prior Publication Data

US 2023/0255421 A1 Aug. 17, 2023

(30) Foreign Application Priority Data

Jul. 10, 2020 (GB) ..... 2010656

(51) Int. Cl.
*A47L 9/28* (2006.01)

(52) U.S. Cl.
CPC ..... *A47L 9/2805* (2013.01); *A47L 9/2842* (2013.01); *A47L 9/2857* (2013.01)

(58) Field of Classification Search
CPC .... A47L 9/2805; A47L 9/2831; A47L 9/2842; A47L 9/2857; A47L 9/2863; A47L 9/2826; A47L 9/2821; A47L 9/2815
See application file for complete search history.

(56) References Cited

U.S. PATENT DOCUMENTS 5,722,109 A 3/1998 Delmas et al.
2002/0083548 A1 7/2002 Hansen
(Continued)

FOREIGN PATENT DOCUMENTS

CN 103239191 A 8/2013
CN 106175599 A 12/2016
(Continued)

OTHER PUBLICATIONS

International Search Report and Written Opinion received for PCT Patent Application No. PCT/GB2021/051373, mailed on Sep. 10, 2021, 12 pages.
(Continued)

*Primary Examiner* — Andrew A Horton
(74) *Attorney, Agent, or Firm* — Tucker Ellis LLP; Michael G. Craig

(57) ABSTRACT

A vacuum cleaner includes: a sensor configured to generate sensor signals based on sensed motion and orientation of the vacuum cleaner; a human-computer interface, HCI; and a controller configured to: process the generated sensor signals to determine a type of cleaning activity being performed by a user using the vacuum cleaner; and control the HCI to provide a recommendation to the user of the vacuum cleaner in dependence on the determined type of cleaning activity.

18 Claims, 11 Drawing Sheets

(56) References Cited

U.S. PATENT DOCUMENTS

| | | | |
|---|---|---|---|
| 2002/0112315 | A1 | 8/2002 | Conrad |
| 2005/0166354 | A1 | 8/2005 | Naoya |
| 2009/0271944 | A1 | 11/2009 | Lovelass |
| 2011/0232687 | A1 | 9/2011 | Stein |
| 2015/0264121 | A1 | 9/2015 | Van Biljon et al. |
| 2015/0265121 | A1 | 9/2015 | Kim et al. |
| 2016/0073844 | A1 | 3/2016 | Park |
| 2016/0235270 | A1 | 8/2016 | Santini |
| 2018/0000304 | A1 | 1/2018 | Zhong et al. |
| 2018/0008112 | A1 | 1/2018 | Ham et al. |
| 2019/0216282 | A1 | 7/2019 | Pohlman et al. |
| 2019/0387943 | A1 | 12/2019 | Kim |
| 2020/0069134 | A1 | 3/2020 | Ebrahimi Afrouzi et al. |
| 2021/0393097 | A1 | 12/2021 | King et al. |
| 2023/0248197 | A1 | 8/2023 | Camplani et al. |
| 2023/0248198 | A1 | 8/2023 | Camplani et al. |
| 2023/0255422 | A1 | 8/2023 | Camplani et al. |
| 2023/0255423 | A1 | 8/2023 | Camplani et al. |
| 2023/0255425 | A1 | 8/2023 | Camplani et al. |
| 2023/0263347 | A1 | 8/2023 | Camplani et al. |
| 2023/0263354 | A1 | 8/2023 | Camplani et al. |
| 2023/0263355 | A1 | 8/2023 | Camplani et al. |

FOREIGN PATENT DOCUMENTS

| | | | |
|---|---|---|---|
| CN | 108670119 | A | 10/2018 |
| DE | 102014113796 | A1 | 3/2016 |
| DE | 102015108464 | A1 | 12/2016 |
| DE | 102018200691 | A1 | 7/2019 |
| EP | 2682034 | A2 | 1/2014 |
| EP | 3058860 | A1 | 8/2016 |
| EP | 3162266 | A1 | 5/2017 |
| EP | 3263004 | A1 | 1/2018 |
| EP | 3278698 | A1 | 2/2018 |
| GB | 2490256 | A | 10/2012 |
| GB | 2572433 | A | 10/2019 |
| GB | 2578872 | A | 6/2020 |
| JP | H04-250128 | A | 9/1992 |
| JP | H05-130960 | A | 5/1993 |
| JP | 05-269063 | A | 10/1993 |
| JP | H05-253152 | A | 10/1993 |
| JP | H06-154139 | A | 6/1994 |
| JP | 2009-172235 | A | 8/2009 |
| JP | 2010-115360 | A | 5/2010 |
| JP | 2011-188963 | A | 9/2011 |
| JP | 2012-101060 | A | 5/2012 |
| JP | 2012-148011 | A | 8/2012 |
| JP | 2013-198702 | A | 10/2013 |
| JP | 2013-202094 | A | 10/2013 |
| JP | 2015-521945 | A | 8/2015 |
| JP | 2015-156900 | A | 9/2015 |
| JP | 2015-165835 | A | 9/2015 |
| JP | 2016-022378 | A | 2/2016 |
| JP | 2017-080410 | A | 5/2017 |
| JP | 2018-101444 | A | 6/2018 |
| JP | 2019-111321 | A | 7/2019 |
| KR | 20180082025 | A | 7/2018 |
| KR | 20190089795 | A | 7/2019 |
| KR | 20200009680 | A | 1/2020 |
| WO | 2012/077621 | A1 | 6/2012 |
| WO | 2018/202367 | A1 | 11/2018 |
| WO | 2020/106420 | A1 | 5/2020 |

OTHER PUBLICATIONS

International Search Report and Written Opinion received for PCT Patent Application No. PCT/GB2021/051369, mailed on Aug. 31, 2021, 12 pages.

International Search Report and Written Opinion received for PCT Patent Application No. PCT/GB2021/051370, mailed on Aug. 30, 2021, 10 pages.

International Search Report and Written Opinion received for PCT Patent Application No. PCT/GB2021/051371, mailed on Sep. 9, 2021, 13 pages.

International Search Report and Written Opinion received for PCT Patent Application No. PCT/GB2021/051372, mailed on Aug. 30, 2021, 10 pages.

International Search Report and Written Opinion received for PCT Patent Application No. PCT/GB2021/051374, mailed on Aug. 31, 2021, 12 pages.

International Search Report and Written Opinion received for PCT Patent Application No. PCT/GB2021/051375, mailed on Sep. 1, 2021, 11 pages.

International Search Report and Written Opinion received for PCT Patent Application No. PCT/GB2021/051376, mailed on Sep. 7, 2021, 11 pages.

International Search Report and Written Opinion received for PCT Patent Application No. PCT/GB2021/051509, mailed on Sep. 17, 2021, 11 pages.

Search Report received for GB Application No. 2010656.3, mailed on Jan. 5, 2021, 1 page.

Search Report received for GB Application No. 2010659.7, mailed on Jan. 5, 2021, 1 page.

Examination Report received for GB Application No. 2305861.3, mailed on Nov. 13, 2023, 1 page.

VACUUM CLEANER

CROSS-REFERENCE TO PRIOR APPLICATION

This application is a § 371 National Stage Application of PCT International Application No. PCT/GB2021/051376 filed Jun. 3, 2021, which claims the priority of United Kingdom Application No. 2010656.3, filed Jul. 10, 2020, each of which are herein incorporated by reference in their entirety.

TECHNICAL FIELD

The present disclosure relates to a vacuum cleaner. In particular, but not exclusively, the present disclosure concerns measures, including methods, apparatus and computer programs, for operating a vacuum cleaner.

BACKGROUND

Broadly speaking, there are four types of vacuum cleaner: 'upright' vacuum cleaners, 'cylinder' vacuum cleaners (also referred to as 'canister' vacuum cleaners), 'handheld' vacuum cleaners and 'stick' vacuum cleaners.

Upright vacuum cleaners and cylinder vacuum cleaners tend to be mains-power-operated.

Handheld vacuum cleaners are relatively small, highly portable vacuum cleaners, suited particularly to relatively low duty applications such as spot cleaning floors and upholstery in the home, interior cleaning of cars and boats etc. Unlike upright cleaners and cylinder cleaners, they are designed to be carried in the hand during use, and tend to be powered by battery.

Stick vacuum cleaners may comprise a handheld vacuum cleaner in combination with a rigid, elongate suction wand which effectively reaches down to the floor so that the user may remain standing while cleaning a floor surface. A floor tool is typically attached to the end of the rigid, elongate suction wand, or alternatively may be integrated with the bottom end of the wand.

Stick vacuum cleaners can be used with a wide variety of detachable tools to facilitate different types of cleaning. Furthermore, the vacuum cleaner and some of the associated tools may have different settings, which can be varied by a user to suit different cleaning scenarios. However, users may at times use sub-optimal tools and/or settings for a particular type of cleaning activity being undertaken.

It is an object of the present disclosure to mitigate or obviate the above disadvantages, and/or to provide an improved or alternative vacuum cleaner.

SUMMARY

According to an aspect of the present disclosure, there is provided a vacuum cleaner comprising: a sensor configured to generate sensor signals based on sensed motion and orientation of the vacuum cleaner; a human-computer interface, HCI; and a controller configured to: process the generated sensor signals to determine a type of cleaning activity being performed by a user using the vacuum cleaner; and control the HCI to provide a recommendation to the user of the vacuum cleaner in dependence on the determined type of cleaning activity.

Advantageously, the HCI provides the user of the vacuum cleaner with a recommendation which is dependent on the type of cleaning activity being performed, as determined by the controller. In this manner, if the user is operating the vacuum cleaner in a sub-optimal manner for the cleaning task being undertaken (e.g. using an incorrect or sub-optimal tool, tool setting or technique), the user will receive feedback, via the HCI, which will prompt the user to re-configure the vacuum cleaner in order to optimize cleaning performance and/or battery performance. This facilitates the user to learn the features of the vacuum cleaner over time.

In embodiments, the HCI comprises a visual display unit and the recommendation comprises a visual recommendation.

In embodiments, the HCI comprises an audio output device and the recommendation comprises an audible recommendation.

In embodiments, the recommendation comprises information relating to a cleaning tool suitable for the determined type of cleaning activity.

In embodiments, the recommendation comprises information relating to one or more of: a stroke rate, a dwell time, and an applied pressure, each being suitable for the determined type of cleaning activity.

In embodiments, the sensor signals are based only on sensed motion of the vacuum cleaner or only on sensed orientation of the vacuum cleaner.

In embodiments, the sensor comprises an inertial measurement unit, IMU.

In embodiments, the vacuum cleaner further comprises a cleaner head comprising an agitator and one or more diagnostic sensors configured to generate further sensor signals based on sensed parameters of the cleaner head.

In embodiments, the controller is configured to process the generated further sensor signals to determine the type of cleaning activity being performed by the user using the vacuum cleaner. In this manner, when additional sensors are available, the additional sensor data are used by the controller to determine the cleaning activity being undertaken. This may improve the accuracy and/or speed at which the current cleaning activity is determined.

In embodiments, the cleaner head further comprises an agitator motor arranged to rotate the agitator and the sensed parameters of the cleaner head comprise the agitator motor current.

In embodiments, the sensed parameters of the cleaner head comprise the pressure applied to the cleaner head.

In embodiments, the cleaner head further comprises an adjustable gate and the recommendation comprises information relating to a setting of the adjustable gate suitable for the determined type of cleaning activity.

In embodiments, the controller is configured to process the sensor signals by performing a pre-processing step and a classification step.

In embodiments, the pre-processing step comprises extracting features from time portions of the sensor signals.

In embodiments, the pre-processing step comprises filtering the sensor signals.

In embodiments, the classification step comprises processing the extracted features using a machine learning classifier. Advantageously, a machine learning classifier can be pre-trained, for example at the factory, by subjecting the vacuum cleaner to a multitude of different cleaning activities/scenarios and defining how the vacuum cleaner should respond in each case. Furthermore, the machine learning classifier may be capable of further learning in the user's home environment.

In embodiments, the machine learning classifier comprises one or more of: an artificial neural network, a random forest and a support-vector machine.

According to an aspect of the present disclosure, there is provided a method of facilitating the use of a vacuum cleaner, the method comprising: generating sensor signals based on sensed motion and orientation of the vacuum cleaner; processing the generated sensor signals to determine a type of cleaning activity being performed by a user using the vacuum cleaner; and providing a recommendation to the user of the vacuum cleaner in dependence on the determined type of cleaning activity.

According to an aspect of the present disclosure, there is provided a computer program comprising a set of instructions, which, when executed by a computerised device, cause the computerised device to perform a method of facilitating the use of a vacuum cleaner, the method comprising: generating sensor signals based on sensed motion and orientation of the vacuum cleaner; processing the generated sensor signals to determine a type of cleaning activity being performed by a user using the vacuum cleaner; and providing a recommendation to the user of the vacuum cleaner in dependence on the determined type of cleaning activity.

The present disclosure is not limited to any particular type of vacuum cleaner. For example, the aspects of the disclosure may be utilised on upright vacuum cleaners, cylinder vacuum cleaners or handheld or 'stick' vacuum cleaners.

It should be appreciated that features described in relation to one aspect of the present disclosure may be incorporated into other aspects of the present disclosure. For example, a method aspect may incorporate any of the features described with reference to an apparatus aspect and vice versa.

DESCRIPTION OF THE DRAWINGS

Embodiments of the present disclosure will now be described by way of example only with reference to the accompanying schematic drawings of which.

DETAILED DESCRIPTION

Figure 1:
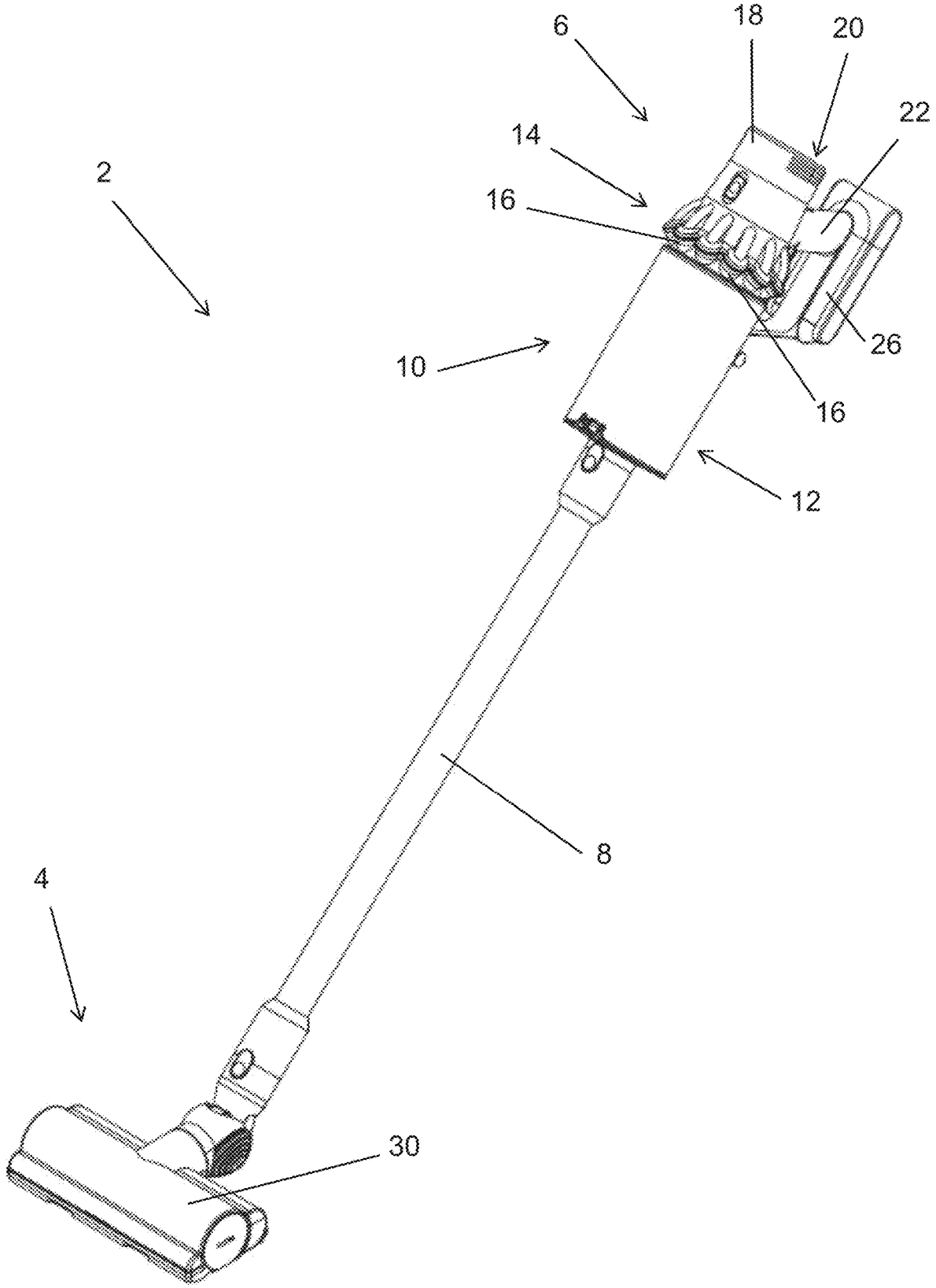
FIG. 1 is a perspective view of a stick vacuum cleaner according to an embodiment of the present disclosure.

FIGS. 1 to 4 illustrate a vacuum cleaner 2 according to embodiments of the present disclosure. The vacuum cleaner 2 is a 'stick' vacuum cleaner comprising a cleaner head 4 connected to a main body 6 by a generally tubular elongate wand 8. The cleaner head 4 is also connectable directly to the main body 6 to transform the vacuum cleaner 2 into a handheld vacuum cleaner. Other removable tools, such as a crevice tool 3, a dusting brush 7 and a miniature motorized cleaner head 5 may be attached directly to the main body 6, or to the end of the elongate wand 8, to suit different cleaning tasks.

The main body 6 comprises a dirt separator 10 which in this case is a cyclonic separator. The cyclonic separator has a first cyclone stage 12 comprising a single cyclone, and a second cyclone stage 14 comprising a plurality of cyclones 16 arranged in parallel. The main body 6 also has a removable filter assembly 18 provided with vents 20 through which air can be exhausted from the vacuum cleaner 2. The main body 6 of the vacuum cleaner 2 has a pistol grip 22 positioned to be held by the user. At an upper end of the pistol grip 22 is a user input device in the form of a trigger switch 24, which is usually depressed in order to switch on the vacuum cleaner 2. However, in some embodiments the physical trigger switch 24 is optional. Positioned beneath a lower end of the pistol grip 22 is a battery pack 26 which comprises a plurality of rechargeable cells 27. A controller 50 and a vacuum motor 52, comprising a fan driven by an electric motor, are provided in the main body 6 behind the dirt separator 10.

Figure 2:
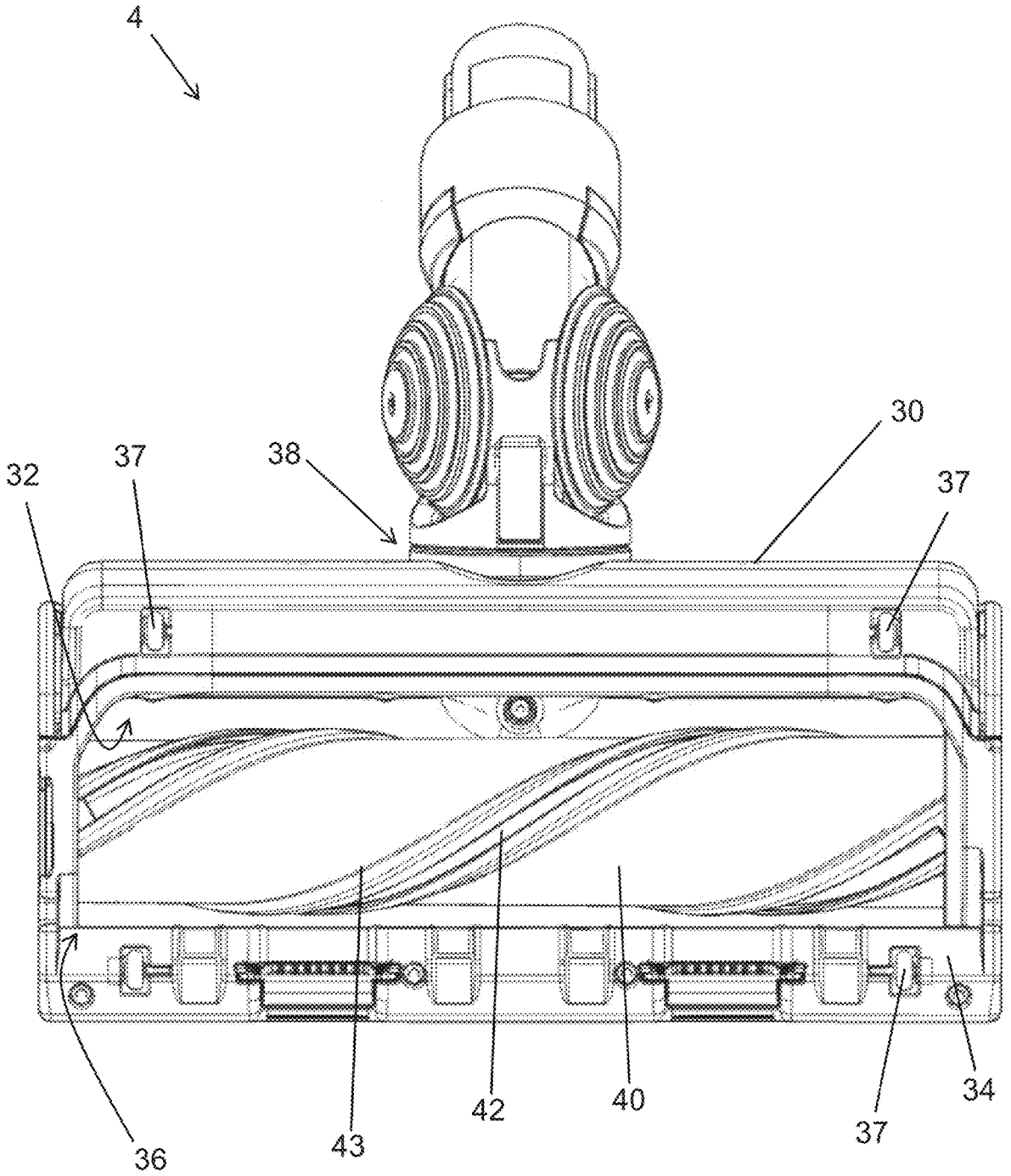
FIG. 2 is a view of a cleaner head of the vacuum cleaner of FIG. 1, shown from underneath.

The cleaner head 4 is shown from underneath in FIG. 2. The cleaner head 4 has a casing 30 which defines a suction chamber 32 and a soleplate 34. The soleplate 34 has a suction opening 36 through which air can enter the suction chamber 32, and wheels 37 for engaging a floor surface. The casing 30 defines an outlet 38 through which air can pass from the suction chamber 32 into the wand 8. Positioned inside the suction chamber 32 is an agitator 40 in the form of a brush bar. The agitator 40 can be driven to rotate inside the suction chamber 32 by an agitator motor 54. The agitator motor 54 of this embodiment is received inside the agitator 40. The agitator 40 has helical arrays of bristles 43 projecting from grooves 42, and is positioned in the suction chamber such that the bristles 43 project out of the suction chamber 34 through the suction opening 36.

Figure 3:
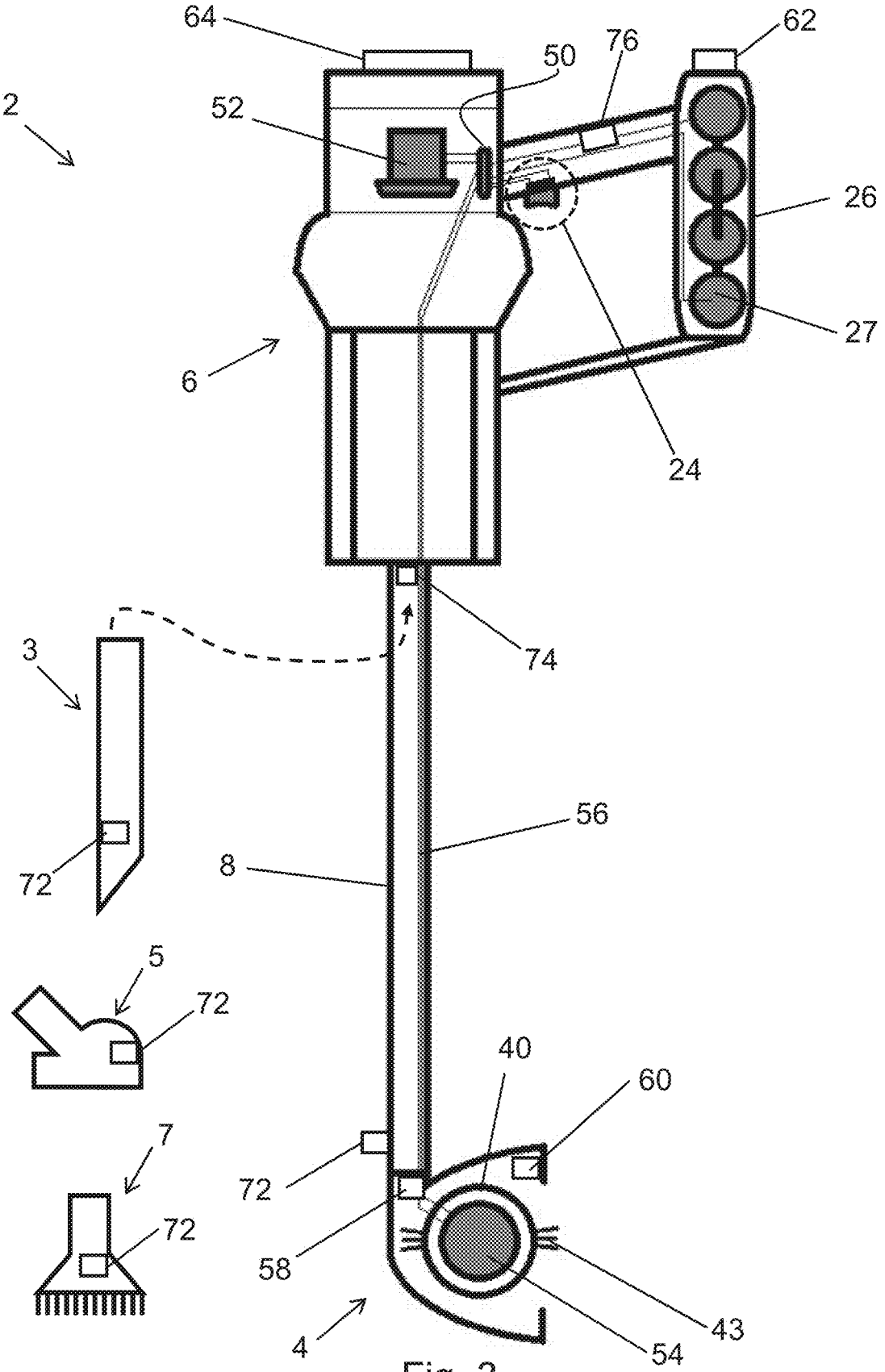
FIG. 3 is a schematic illustration of electrical components of the vacuum cleaner of FIG. 1.

FIG. 3 is a schematic representation of the electrical components of the vacuum cleaner 2. The controller 50 manages the supply of electrical power from the cells 27 of the battery pack 26 to the vacuum motor 52. When the vacuum motor 52 is powered on, this creates a flow of air so as to generate suction. Air with dirt entrained therein is sucked into the cleaner head 4 (or, when attached, one of the other tools such as the crevice tool 3, the mini motorised cleaner head 5, or the dusting brush 7), into the suction chamber 32 through the suction opening 36. From there, the air is sucked through the outlet 38 of the cleaner head 4, along the wand 8 and into the dirt separator 10. Entrained dirt is removed by the dirt separator 10 and then relatively clean air is drawn through the vacuum motor 52, through the filter assembly 18 and out of the vacuum cleaner 2 through the vents 20. In addition, the controller 50 also supplies electrical power from the battery pack 26 to the agitator motor 54 of the cleaner head 4, through wires 56 running along the inside of the wand, so as to rotate the agitator 40. When the cleaner head 4 is on a hard floor, it is supported by the wheels 37 and the soleplate 34 and agitator 40 are spaced apart from the floor surface. When the cleaner head 4 is resting on a carpeted surface, the wheels 37 sink into the pile of the carpet and the soleplate 34 (along with the rest of the cleaner head 4) is therefore positioned further down. This allows carpet fibres to protrude towards (and potentially through) the suction opening 36, whereupon they are disturbed by bristles 43 of the rotating agitator 40 so as to loosen dirt and dust therefrom.

Figure 4:
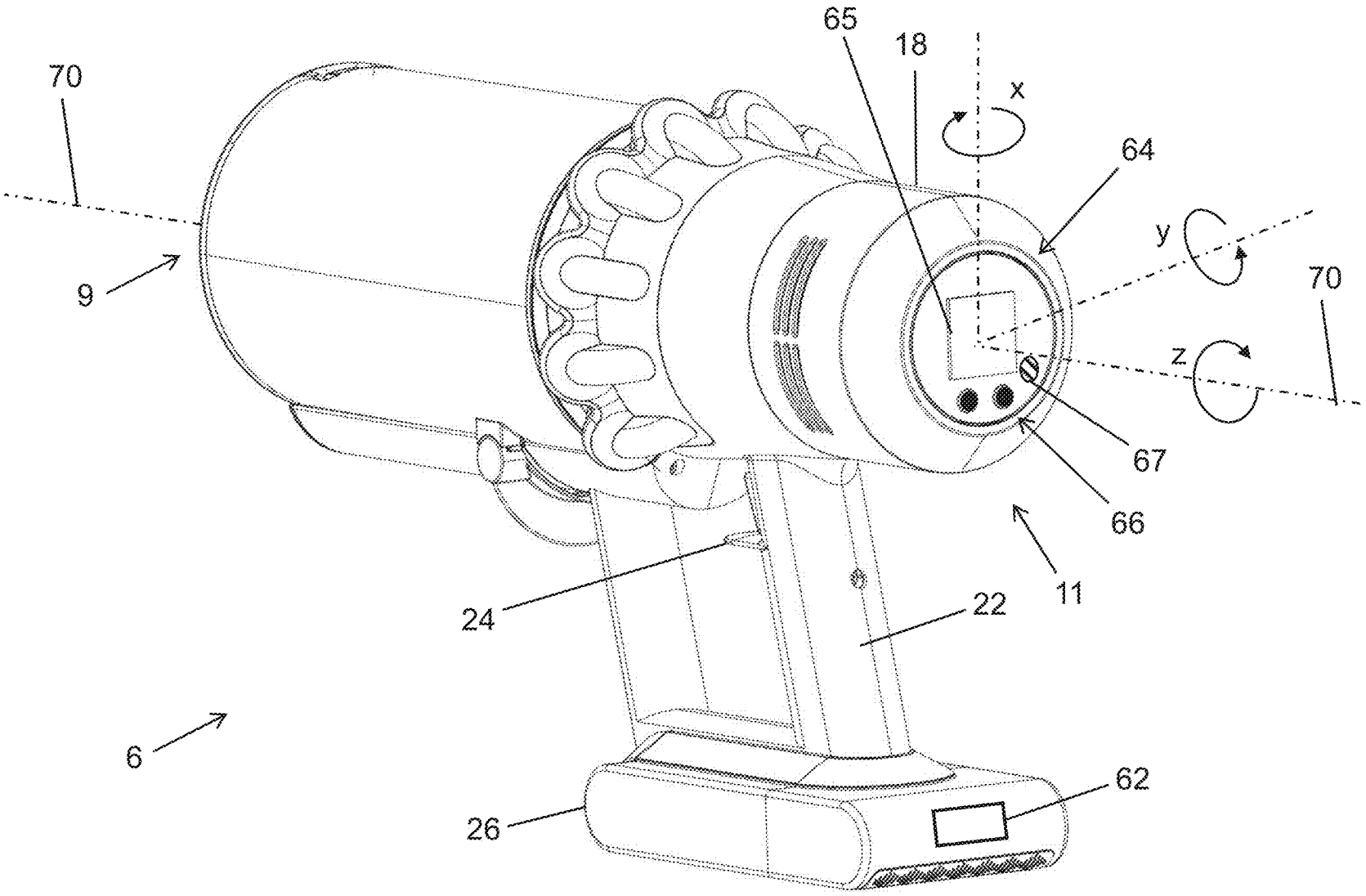
FIG. 4 is a perspective view of a main body of the stick vacuum cleaner of FIG. 1.

Vacuum cleaners 2 according to embodiments of the present disclosure comprise additional components, which are visible in FIGS. 3 and 4. These include one or more of: a current sensor 58 for sensing the electrical current drawn by the agitator motor 54 of the cleaner head 4, a pressure sensor 60 for sensing the pressure applied to the soleplate 34 of the cleaner head 4, an inertial measurement unit (IMU) 62 which is sensitive to motion and orientation of the main body 6 of the vacuum cleaner 2, a human computer interface (HCI) 64, one or more proximity sensors, typically in the form of time of flight (TOF) sensors 72, a tool switch sensor 74 and a capacitive sensor 76 located in the pistol grip 22. Although the current sensor 58 is shown as being situated in the cleaner head 4, it could alternatively be located in the main body 6. For example, the current sensor 58 could be integrated as part of the controller 50, provided it is operable to sense electrical current supplied to the agitator motor 54 from the battery 26 via the wires 56. In the illustrated embodiment, one TOF sensor 72 is located at the end of the detachable wand 8, close to where the cleaner head 4, or one of the other tools 3, 5, 7, is attached. Further TOF sensors 72 may be provided on the removable tools 3, 5, 7 themselves. Each TOF sensor 72 generates a sensor signal dependent on the proximity of objects to the TOF sensor 72. Suitable TOF sensors 72 include radar or laser devices. The tool switch sensor 74 is located on the main body 6 of the vacuum cleaner 2 and generates signals dependent on whether a tool 3, 4, 5, 7 or the wand 8 is attached to the main body 6. In embodiments, the tool switch sensor 74 generates signals dependent on the type of tool 3, 4, 5, 7 attached to main body 6 or the wand 8. The capacitive sensor 76 is located in the pistol grip 22 and generates signals dependent on whether a user is gripping the pistol grip. In embodiments, the vacuum cleaner 2 may comprise one or more additional IMUs. For example, the cleaner head 4 may comprise an IMU which is sensitive to motion and orientation of the cleaner head 4 and which generates further sensor signals to supplement those generated by the IMU 62 of the main body 6. The IMU 62 may comprise one or more accelerometers, one or more gyroscopes and/or one or more magnetometers.

As shown in more detail in FIG. 4, the main body 6 of the vacuum cleaner 2 defines a longitudinal axis 70 which runs from a front end 9 to a rear end 11 of the main body 6. When it is attached to the front end 9 of the main body 6, the wand 8 is parallel to (and in this case collinear with) the longitudinal axis 70. In the illustrated embodiment, the HCI 64 comprises a visual display unit 65, more particularly a planar, full colour, backlit thin-film transistor (TFT) screen. The screen 65 is controlled by the controller 50 and receives power from the battery 26. The screen displays information to the user, such as an error message, an indication of a mode the vacuum cleaner 2 is operating in, or an indication of remaining battery 26 life. The screen 65 faces substantially rearwards (i.e. its plane is orientated substantially normal to the longitudinal axis 70). Positioned beneath the screen 65 (in the vertical direction defined by the pistol grip 22) is a pair of control members 66, also forming part of the HCI 64 and each of which is positioned adjacent to the screen 65 and is configured to receive a control input from the user. In embodiments, the control members are configured to change the mode of the vacuum cleaner, for example to manually increase or decrease the power of the vacuum motor 52. In embodiments, the HCI 64 also comprises an audio output device such as a speaker 67 which can provide audible feedback to the user.

Figure 5A:
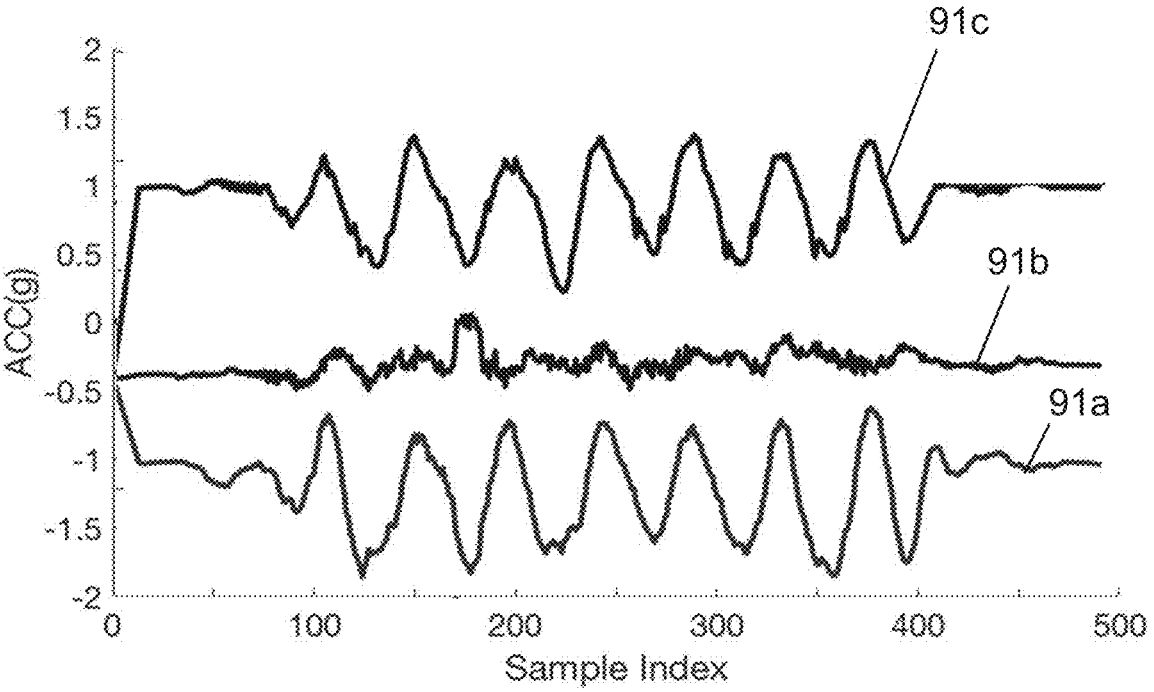
FIGS. 5*a* and 5*b* illustrate sensor signals corresponding to linear and angular acceleration generated by an inertial measurement unit of a vacuum cleaner according to embodiments of the present disclosure.
Figure 5B:
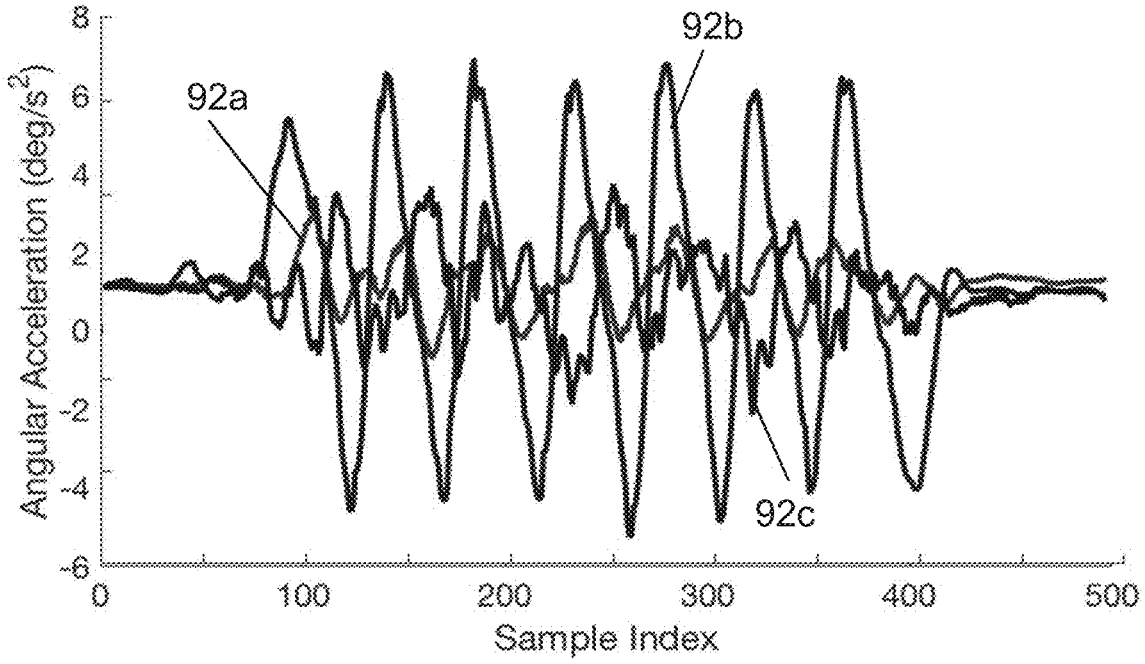
Figure 6:
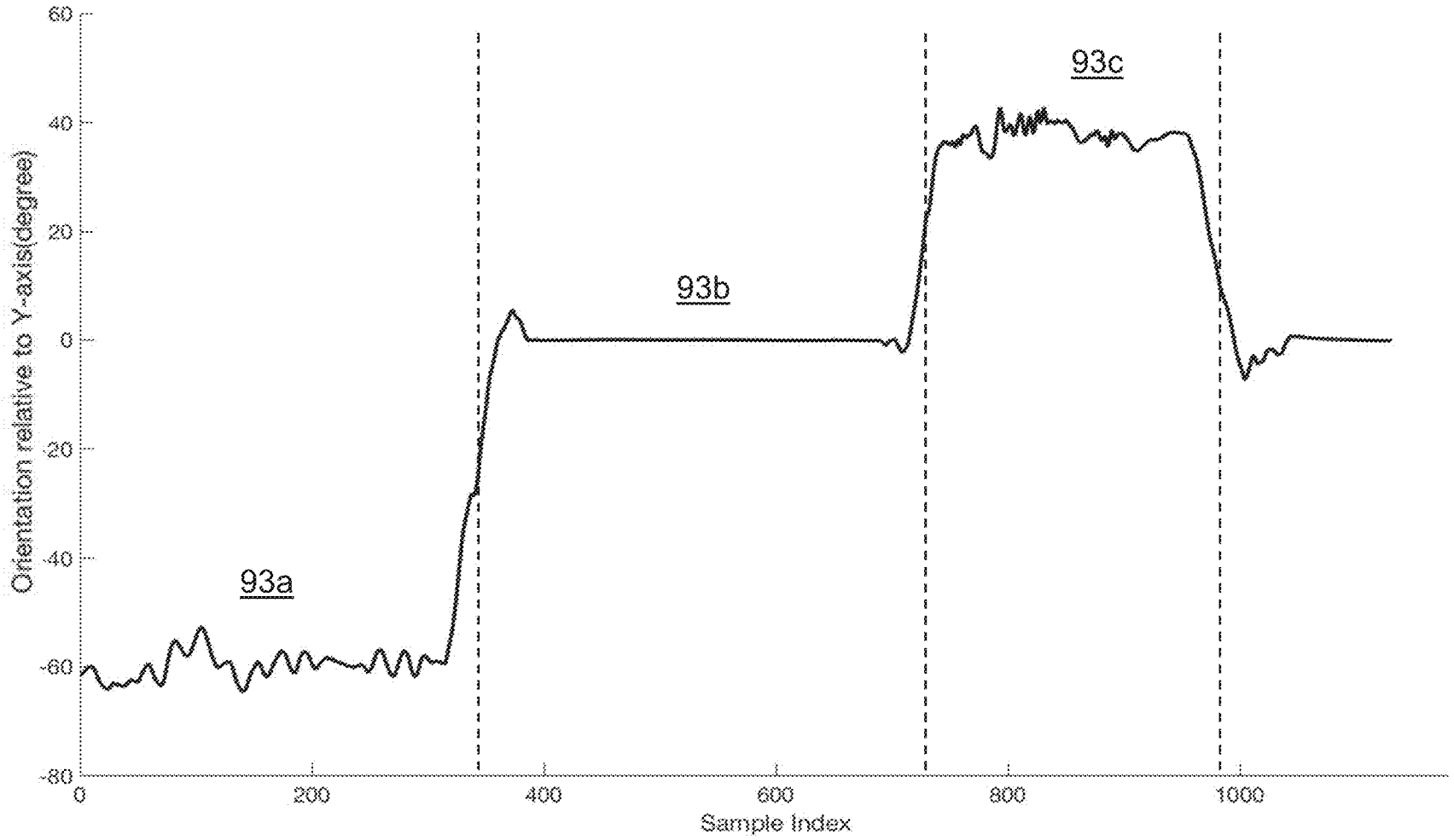
FIGS. 6 and 7 illustrates further sensor signals corresponding to orientation generated by the inertial measurement unit of a vacuum cleaner according to embodiments of the present disclosure.
Figure 7:
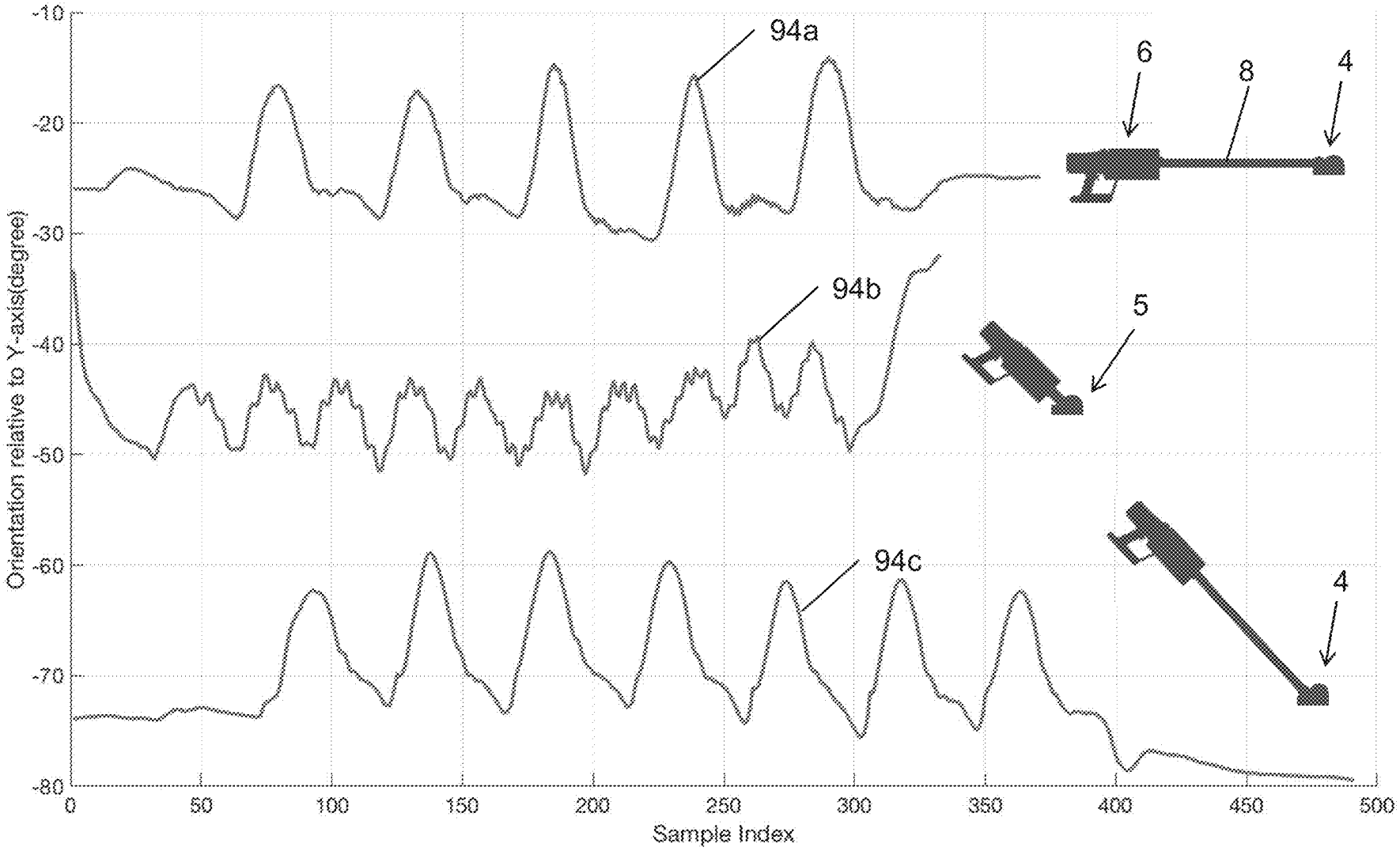

The IMU 62 generates sensor signals dependent on the motion and orientation of the main body 6 of the vacuum cleaner 2 in three spatial dimensions (x, y, and z). The motion includes the linear acceleration and angular acceleration of the main body 6. FIG. 5*a* illustrates exemplary generated IMU 62 sensor data corresponding to the linear acceleration of the main body 6 before, during and after a cleaning operation. The time scale shows the index of samples which were gathered at a sampling rate of 25 Hz. The vertical scale is in units of acceleration due to gravity. Traces 91*a*, 91*b* and 91*c* correspond to the linear acceleration of the main body 6 in the x, y and z directions respectively. FIG. 5*b* illustrates exemplary generated IMU 62 sensor data corresponding to the angular acceleration of the main body 6 before, during and after the same cleaning operation as represented in FIG. 5*a*. Traces 92*a*, 92*b* and 92*c* correspond to the angular acceleration about the x, y and z axes respectively. In both FIGS. 5*a* and 5*b*, the vacuum cleaner 2 is initially static (at rest). This is followed by a cleaning session comprising cleaning strokes, giving rise to oscillatory behaviour in some of the generated sensor data. Finally, the vacuum cleaner 2 is again returned to rest. The data shown in FIGS. 5*a* and 5*b* have been smoothed, for example by means of a band-pass filter or a low-pass filter. FIG. 6 illustrates example generated IMU 62 sensor data corresponding to of the orientation of the main body 6 about the y axis during different hand-held cleaning operations. Specifically, interval 93*a* corresponds to cleaning of a low-level surface, e.g. a skirting board, interval 93*b* corresponds to a period during which the main body 6 is at rest on a table and interval 93*c* corresponds to cleaning of an elevated surface, for example a ceiling, blind, curtain, or the top of a cupboard. FIG. 7 illustrates further exemplary generated IMU 62 sensor data corresponding to orientation of the main body 6 about the y axis during different cleaning operations using the motorized cleaner heads 4, 5. Trace 94*a* corresponds to cleaning under furniture using the main cleaner head 4 attached to the wand 8. Trace 94*b* corresponds to stair cleaning using the miniature motorized cleaner head 5 attached directly to the main body 6, without using the wand 8. Trace 94*c* corresponds to normal upright vacuum cleaning using the cleaner head 4 attached to the wand 8. It should be appreciated that the different cleaning activities give rise to different signatures in the sensor data generated by the IMU 62. In this manner, it should be appreciated that the IMU 62 sensor data can be processed to infer information about the cleaning activity being performed by a user using the vacuum cleaner, or about the environment in which the vacuum cleaner is being operated.

Figure 8:
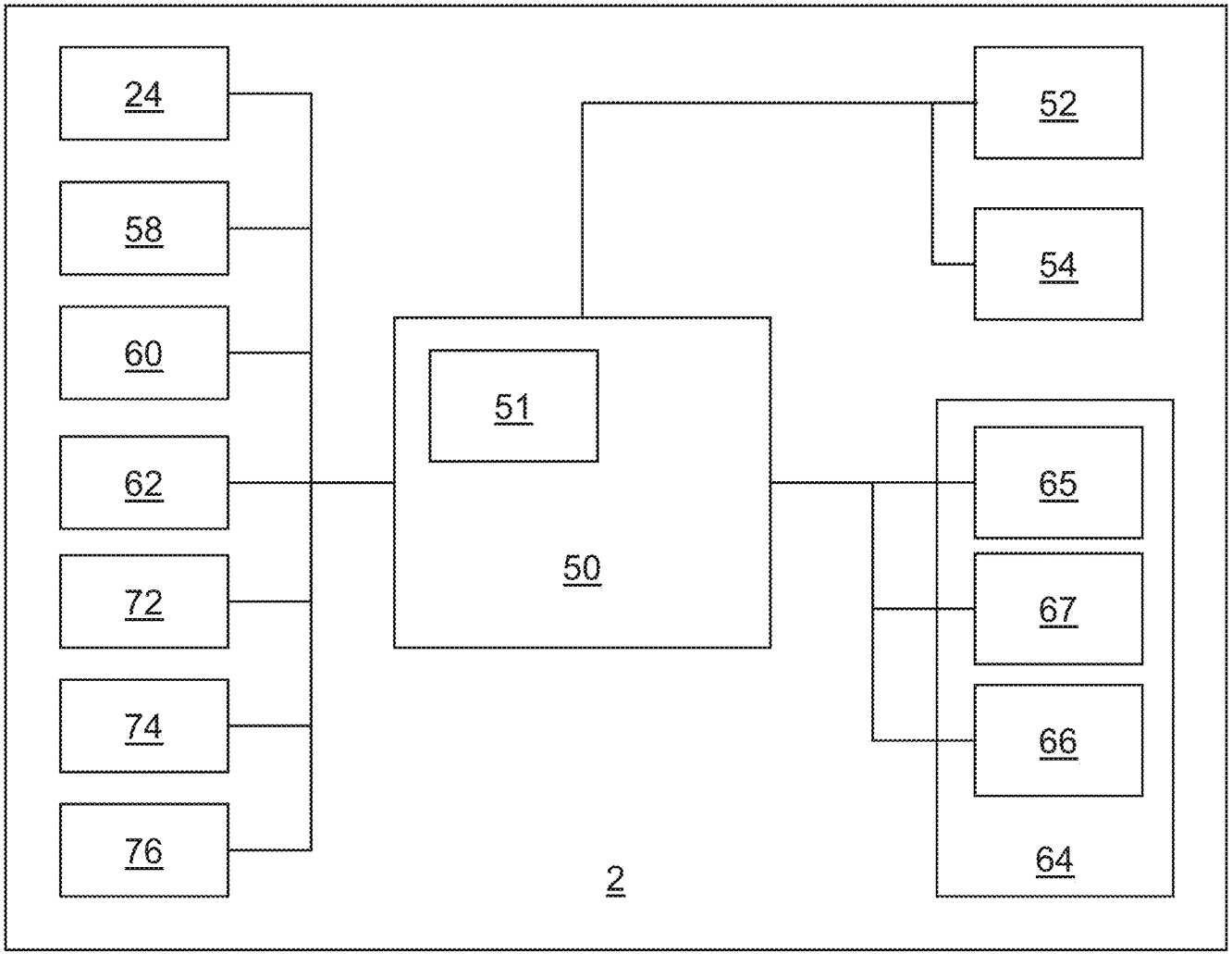
FIG. 8 is a simplified schematic illustration of electrical components of the vacuum cleaner of FIG. 3, showing electrical connections between sensors, a human-computer interface, motors and the controller according to embodiments of the present disclosure.

FIG. 8 illustrates schematically the electrical layout of the vacuum cleaner 2 according to embodiments. In embodiments, the controller 50 receives and processes signals generated by one or more of the trigger 24, the current sensor 58, the pressure sensor 60, the IMU 62, the one or more TOF sensors 72, the tool switch sensor 74 and the capacitive sensor 76. The controller 50 has a memory 51 on which are stored instructions according to which the controller 50 processes the sensor signals. Based on the processing of the sensor signals, the controller 50 controls one or more of the vacuum motor 52, the agitator motor 54 and the HCI 64 in order to enhance operation of the vacuum cleaner 2 and thereby improve the user experience. Example enhancements include improved pickup of dirt and improved battery life, amongst others.

Figure 9:
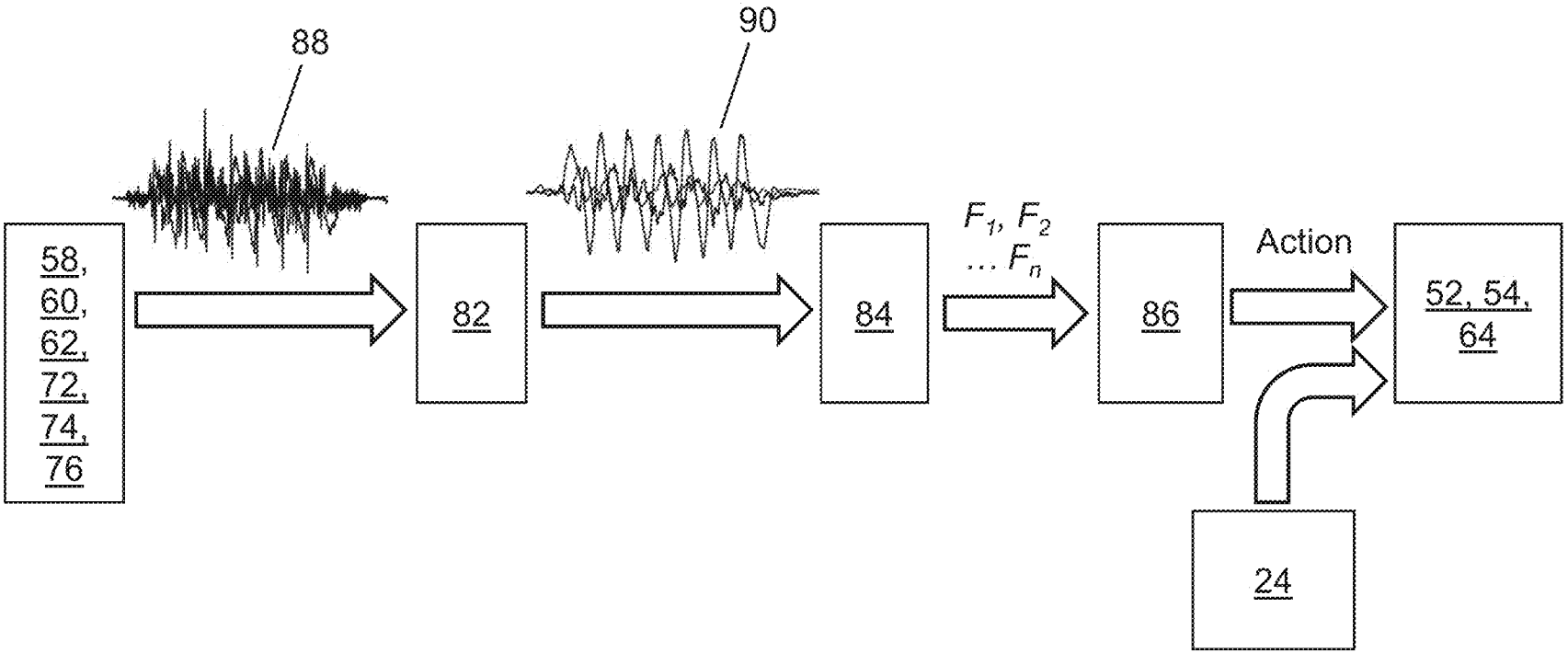
FIG. 9 is a block diagram illustrating example sensor signal processing performed by the controller according to various embodiments of the present disclosure.

FIG. 9 is a block diagram which illustrates example sensor signal processing performed by the controller 50 according to various embodiments of the present disclosure. Unfiltered sensor signals 88 are received at the controller 50 from one or more of the available sensors. Different embodiments utilize sensor signals from different sensors. Some embodiments utilize sensor signals from only one sensor, such as the IMU 62, for example. A band-pass filter or low-pass filter 82 filters the raw sensor signals 88 to generate smoothed sensor signals 90 which are more suitable for further processing. At block 84, pre-determined features $F_1$, $F_2 \ldots F_n$ are extracted from the smoothed sensor signals and subsequently analysed by a classifier 86. In embodiments, the classifier 86 determines, from the extracted features, a particular cleaning activity being performed by a user using the vacuum cleaner 2. In other embodiments, the classifier 86 determines, from the extracted features a particular surface type on which the vacuum cleaner 2 is being operated. In other embodiments, the classifier 86 determines, from the extracted features, whether the vacuum cleaner 2 is actively being used, to assist in providing a trigger-less vacuum cleaner 2. Having determined the above, the controller 50 causes an action or actions to be performed involving one or more of the vacuum motor 52, agitator motor 54 and HCI 64, which are configured in dependence on the classifier 86 output, and optionally on the status of the trigger 24. It should be appreciated that the filter 82, feature extraction block 84 and classifier 86 are in general implemented as software modules which are executed on or under the control of the controller 50. The controller memory 51 stores sets of instructions defining the operation of the filter 82, feature extraction 84, classifier 86 and resultant action. In embodiments, the classifier is based on a machine learning classifier such as an artificial neural network, a random forest, a support-vector machine or any other appropriate trained model. The model could have been pre-trained, for example at the factory, using a supervised learning approach. A sliding window approach is generally used to span the filtered sensor signals and extract features corresponding to that particular time portion of the signal. Consecutive frames usually overlap to some degree but are usually processed separately. It should be appreciated that it is not always necessary to receive and process sensor data from all of the available sensors. For example, in embodiments the controller 50 may process only IMU 62 sensor data to obtain a classifier output. Furthermore, in the case of IMU 62 sensor data, the controller 50 may for example take account only of IMU 62 sensor data relating to orientation of the vacuum cleaner 2, or only IMU 62 sensor data relating to acceleration of the vacuum cleaner 2.

Figure 10:
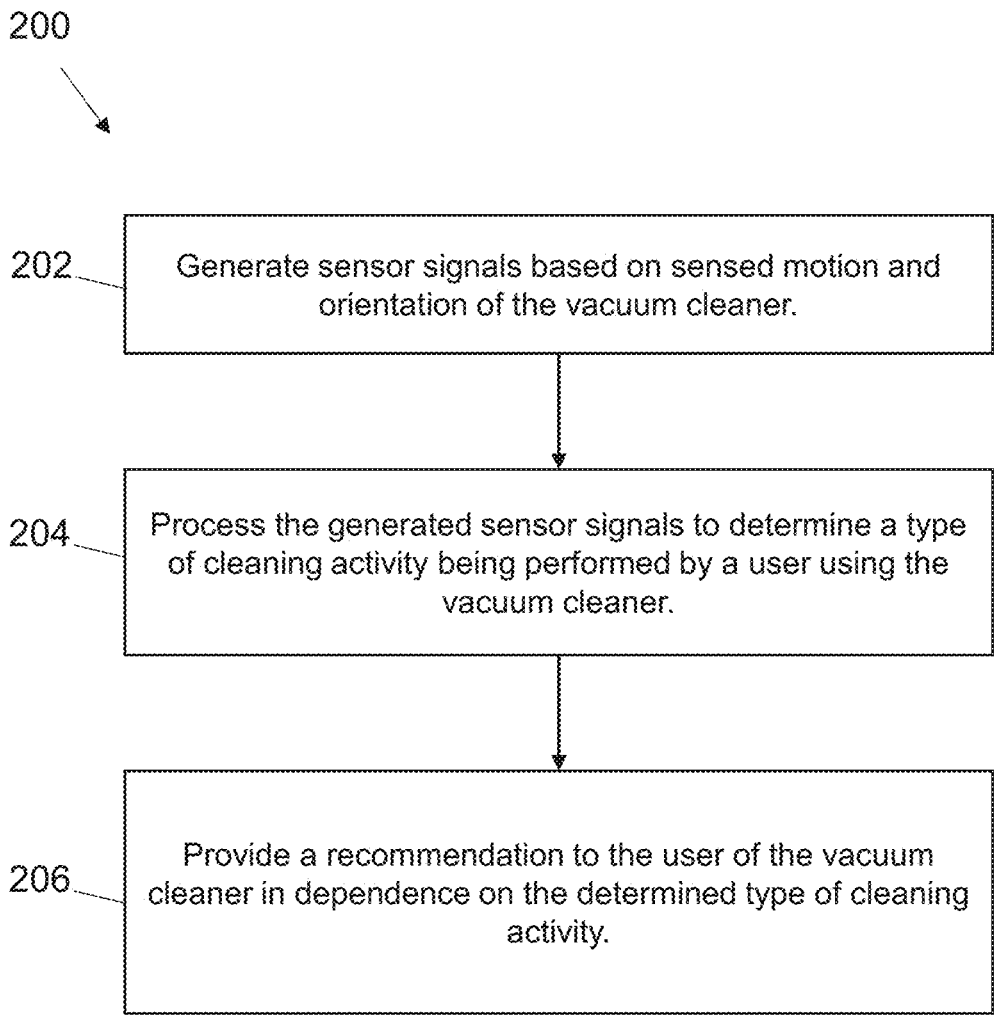
FIG. 10 is a flow diagram showing a method of facilitating the use of a vacuum cleaner according to an embodiment of the present disclosure.

FIG. 10 is a flow diagram showing a method 200 of facilitating the use of a vacuum cleaner 2 according to embodiments. In step 202, sensor signals based on sensed motion and orientation of the vacuum cleaner are generated, for example by the IMU 62. In step 204, the controller 50 processes generated sensor signals to determine a type of cleaning activity being performed by a user using the vacuum cleaner 2. In step 206, a recommendation is provided to the user of the vacuum cleaner 2 in dependence on the determined type of cleaning activity. The recommendation can take the form of a visual recommendation produced on the screen 65 and/or an audible recommendation produced on the speaker 67. The recommendation may be cancelled or acknowledged by the user by pressing one of the control members 66. In embodiments, the controller 50 processes the sensor signals in accordance with the example sensor signal processing described above with reference to FIG. 9.

Figure 11A:
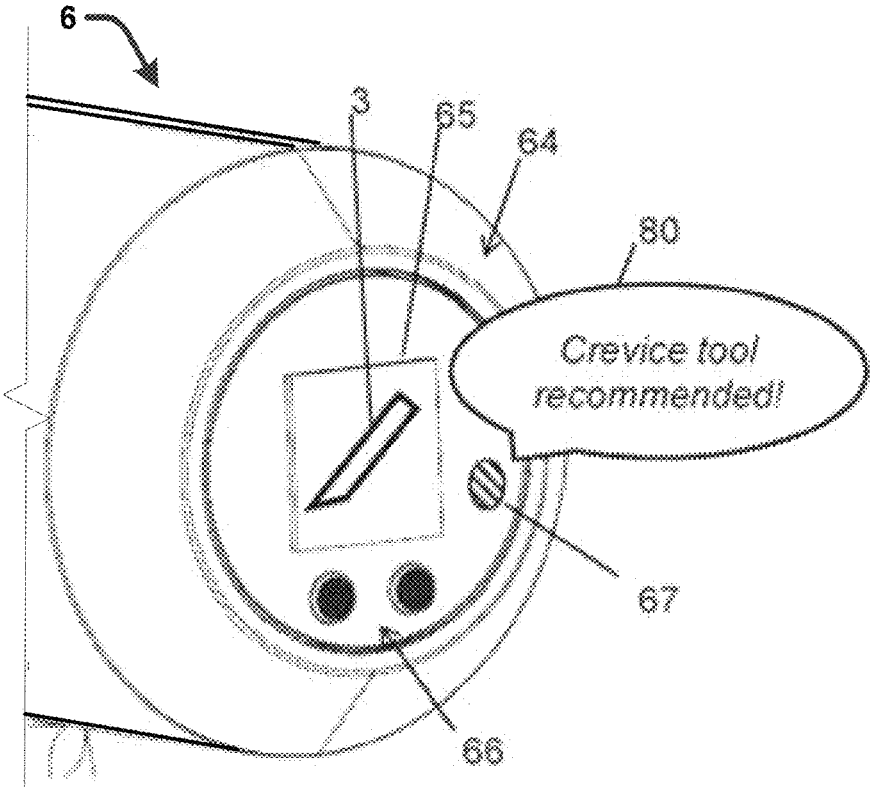
FIGS. 11*a* and 11*b* illustrate schematically the operation of the human computer interface of the vacuum cleaner of FIG. 1 according to an embodiment of the present disclosure.
Figure 11B:
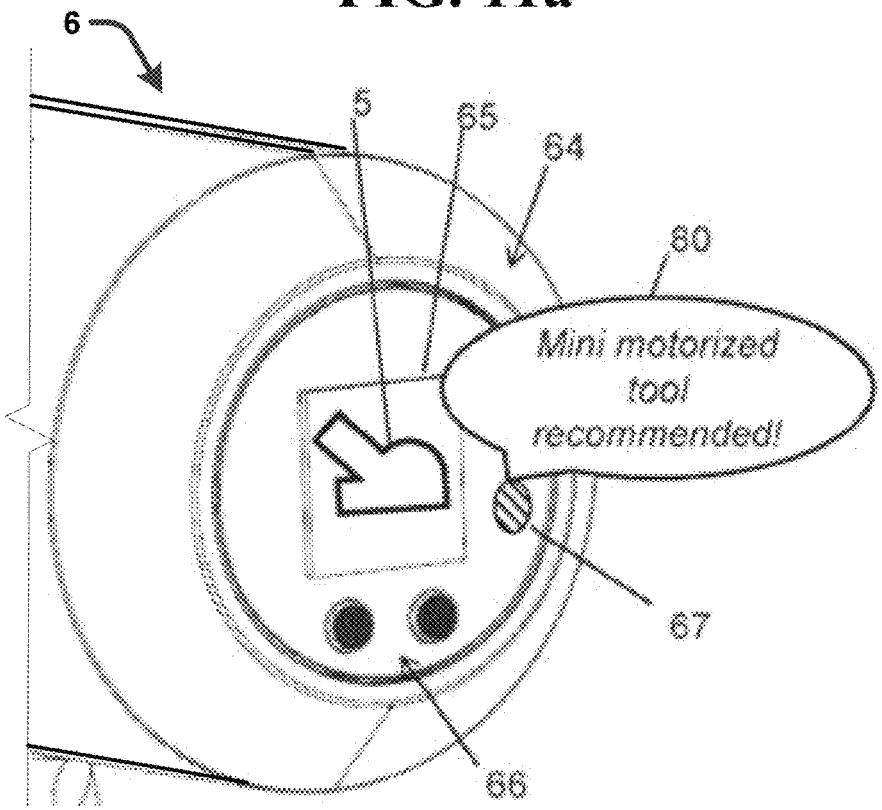

With reference to FIGS. 11*a* and 11*b*, in embodiments, the recommendation comprises information relating to a recommended cleaning tool which is deemed suitable for the type of cleaning activity determined by the controller 50. For example, if the controller 50 determines that the user is manoeuvring the vacuum cleaner in a manner indicative of crevice cleaning, a visual representation of the crevice tool 3 is displayed on the screen 65 accompanied, optionally, by an audible recommendation 80 to use the crevice tool 3 produced on the speaker 67. In FIG. 11*b*, the type of cleaning activity determined by the controller 50 corresponds to stair cleaning or upholstery cleaning. Accordingly, a visual representation of the miniature motorized tool 5 is displayed on the screen 65 accompanied by an audible recommendation 80 to use the miniature motorized tool 5. In embodiments, the recommendation is only displayed when the user is not using the optimal tool for the cleaning activity currently being undertaken. For example, if the user is performing crevice cleaning using a dusting brush 7 rather than the crevice tool 3, the recommendation to use the crevice tool 3 is provided to the user. However, if the user is already using the crevice tool 3 then no recommendation need be provided.

In embodiments, the recommendation comprises information relating to a recommended cleaning technique, such as the cleaning stroke rate, dwell time (the length of time for which the vacuum cleaner is held over a certain area), applied pressure, or a configuration of a cleaning tool (for example, the position of a suction gate on the cleaner head 4), each being suitable for the type of cleaning activity determined by the controller 50. When the vacuum cleaner 2 is being used with the cleaner head 4, the controller 50 may additionally process signals based on sensed parameters of the cleaner head 4 in determining the type of cleaning activity being performed. Example parameters include the agitator motor 54 current, sensed by current sensor 58, and the pressure on the cleaner head 4 sensed by the pressure sensor 60.

In embodiments of the present disclosure, the vacuum cleaner 2 comprises a controller 50. The controller 50 is configured to perform various methods described herein. In embodiments, the controller comprises a processing system. Such a processing system may comprise one or more processors and/or memory. Each device, component, or function as described in relation to any of the examples described herein, for example the IMU 62 and/or HCI 64 may similarly comprise a processor or may be comprised in apparatus comprising a processor. One or more aspects of the embodiments described herein comprise processes performed by apparatus. In some examples, the apparatus comprises one or more processors configured to carry out these processes. In this regard, embodiments may be implemented at least in part by computer software stored in (non-transitory) memory and executable by the processor, or by hardware, or by a combination of tangibly stored software and hardware (and tangibly stored firmware). Embodiments also extend to computer programs, particularly computer programs on or in a carrier, adapted for putting the above described embodiments into practice. The program may be in the form of non-transitory source code, object code, or in any other non-transitory form suitable for use in the implementation of processes according to embodiments.

The carrier may be any entity or device capable of carrying the program, such as a RAM, a ROM, or an optical memory device, etc.

The one or more processors of processing systems may comprise a central processing unit (CPU). The one or more processors may comprise a graphics processing unit (GPU). The one or more processors may comprise one or more of a field programmable gate array (FPGA), a programmable logic device (PLD), or a complex programmable logic device (CPLD). The one or more processors may comprise an application specific integrated circuit (ASIC). It will be appreciated by the skilled person that many other types of device, in addition to the examples provided, may be used to provide the one or more processors. The one or more processors may comprise multiple co-located processors or multiple disparately located processors. Operations performed by the one or more processors may be carried out by one or more of hardware, firmware, and software. It will be appreciated that processing systems may comprise more, fewer and/or different components from those described.

The techniques described herein may be implemented in software or hardware, or may be implemented using a combination of software and hardware. They may include configuring an apparatus to carry out and/or support any or all of techniques described herein. Although at least some aspects of the examples described herein with reference to the drawings comprise computer processes performed in processing systems or processors, examples described herein also extend to computer programs, for example computer programs on or in a carrier, adapted for putting the examples into practice. The carrier may be any entity or device capable of carrying the program. The carrier may comprise a computer readable storage media. Examples of tangible computer-readable storage media include, but are not limited to, an optical medium (e.g., CD-ROM, DVD-ROM or Blu-ray), flash memory card, floppy or hard disk or any other medium capable of storing computer-readable instructions such as firmware or microcode in at least one ROM or RAM or Programmable ROM (PROM) chips.

Where in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the present disclosure that are described as preferable, advantageous, convenient or the like are optional and do not limit the scope of the independent claims. Moreover, it is to be understood that such optional integers or features, whilst of possible benefit in some embodiments of the present disclosure, may not be desirable, and may therefore be absent, in other embodiments.

The invention claimed is:

1. A vacuum cleaner comprising:

a body a sensor disposed in the body and configured to generate sensor signals based on sensed motion and orientation of the vacuum cleaner;

a human-computer interface (HCI) comprising a user interface (UI) disposed in the body with which a user can interact; and a controller configured to:

process the generated sensor signals to determine a type of cleaning activity being performed by the user using the vacuum cleaner; and control the HCI to provide a recommendation using the UI to the user of the vacuum cleaner in dependence on the determined type of cleaning activity.

2. The vacuum cleaner of claim 1, wherein the HCI comprises a visual display unit, and wherein the recommendation comprises a visual recommendation displayed on the visual display unit.

3. The vacuum cleaner of claim 1, wherein the HCI comprises an audio output device, and wherein the recommendation comprises an audible recommendation played by the audio output device.

4. The vacuum cleaner of claim 1, wherein the recommendation comprises information relating to a cleaning tool suitable for the determined type of cleaning activity.

5. The vacuum cleaner of claim 1, wherein the recommendation comprises information that determines a type of cleaning activity, wherein the information is related to one or more of:

a stroke rate;

a dwell time; and an applied pressure.

6. The vacuum cleaner of claim 1, wherein the sensor signals are based only on sensed motion of the vacuum cleaner or only on sensed orientation of the vacuum cleaner.

7. The vacuum cleaner of claim 1, wherein the sensor comprises an inertial measurement unit, IMU.

8. The vacuum cleaner of claim 1, further comprising:

a cleaner head comprising an agitator; and one or more diagnostic sensors configured to generate further sensor signals based on sensed parameters of the cleaner head, wherein the controller is configured to process the generated further sensor signals to determine the type of cleaning activity being performed by the user using the vacuum cleaner.

9. The vacuum cleaner of claim 8, wherein the cleaner head further comprises an agitator motor arranged to rotate the agitator, and wherein the sensed parameters of the cleaner head comprise the agitator motor current.

10. The vacuum cleaner of claim 8, wherein the sensed parameters of the cleaner head comprise the pressure applied to the cleaner head.

11. The vacuum cleaner of claim 8, wherein the cleaner head further comprises an adjustable gate, and wherein the recommendation comprises information relating to a setting of the adjustable gate suitable for the determined type of cleaning activity.

12. The vacuum cleaner of claim 1, wherein the controller is configured to process the sensor signals by performing a pre-processing step and a classification step.

13. The vacuum cleaner of claim 12, wherein the pre-processing step comprises extracting features from time portions of the sensor signals.

14. The vacuum cleaner of claim 13, wherein the classification step comprises processing the extracted features using a machine learning classifier.

15. The vacuum cleaner of claim 14, wherein the machine learning classifier comprises one or more of: an artificial neural network, a random forest and a support-vector machine.

16. The vacuum cleaner of claim 12, wherein the pre-processing step comprises filtering the sensor signals.

17. A method of facilitating the use of a vacuum cleaner, the method comprising:

generating sensor signals based on sensed motion and orientation of the vacuum cleaner;

processing the generated sensor signals to determine a type of cleaning activity being performed by a user using the vacuum cleaner; and providing a recommendation to the user of the vacuum cleaner in dependence on the determined type of cleaning activity.

18. A non-transient storage device comprising a set of instructions, which, when executed by a computerised device, cause the computerised device to perform a method of facilitating the use of a vacuum cleaner, the method comprising:

generating sensor signals based on sensed motion and orientation of the vacuum cleaner;

processing the generated sensor signals to determine a type of cleaning activity being performed by a user using the vacuum cleaner; and providing a recommendation to the user of the vacuum cleaner in dependence on the determined type of cleaning activity.

* * * * *